US007189100B1

(12) United States Patent
Colbourne

(10) Patent No.: US 7,189,100 B1
(45) Date of Patent: Mar. 13, 2007

(54) CORD RETAINING HOUSING AND METHOD

(76) Inventor: Jerome G. Colbourne, 69 Oakland Ter., Hartford, CT (US) 06112

( * ) Notice: Subject to any disclaimer, the term of this patent is extended or adjusted under 35 U.S.C. 154(b) by 0 days.

(21) Appl. No.: 11/060,160

(22) Filed: Feb. 18, 2005

(51) Int. Cl.
*H01R 13/62* (2006.01)

(52) U.S. Cl. ..... 439/369; 439/367

(58) Field of Classification Search ..... 439/369, 439/370, 371, 456, 457
See application file for complete search history.

(56) References Cited

U.S. PATENT DOCUMENTS

| | | | | |
|---|---|---|---|---|
| 3,183,302 | A | 5/1965 | Wochner et al. | |
| 3,344,393 | A * | 9/1967 | Hendee | 439/369 |
| 4,643,505 | A * | 2/1987 | House et al. | 439/369 |
| 4,749,363 | A | 6/1988 | Luska et al. | |
| 4,875,874 | A | 10/1989 | Windsor, Jr. | |
| 5,135,409 | A * | 8/1992 | Thompson | 439/367 |
| 5,217,387 | A * | 6/1993 | Hull et al. | 439/367 |
| 5,888,105 | A | 3/1999 | Brown et al. | |
| 5,921,799 | A | 7/1999 | Forrester | |
| 5,931,702 | A | 8/1999 | Fladung | |
| 6,196,859 | B1 * | 3/2001 | Garlarza | 439/369 |
| 6,250,946 | B1 * | 6/2001 | Tardy | 439/367 |
| 6,454,576 | B1 | 9/2002 | Hedrick et al. | |
| 6,454,579 | B1 | 9/2002 | Davis | |
| 2002/0182936 | A1 | 12/2002 | Fowler | |
| 2004/0097120 | A1 * | 5/2004 | Limber et al. | 439/369 |

* cited by examiner

*Primary Examiner*—Hae Moon Hyeon

(57) ABSTRACT

A cord retaining housing and method includes a housing that has a first end wall, a second wall and a peripheral wall extending between the first and second end walls. The peripheral wall has a break therein so that a first section and a second section are defined. A hinge hingedly couples the first section to the second section so that the first section may be positioned in a closed or open position. Each of the first and second ends walls has a distal edge with respect to the second section. Each of the distal edges has a notch therein. A mated female and male plug is positioned in the housing. Cords attached the male and female plugs are placed in the notches and the first section is positioned in the closed position.

6 Claims, 2 Drawing Sheets

CORD RETAINING HOUSING AND METHOD

BACKGROUND OF THE INVENTION

1. Field of the Invention

The present invention relates to cord retaining housing devices and more particularly pertains to a new cord retaining housing device for holding together a mated pair of male and female plugs in such a manner that the plugs cannot be removed from each other.

2. Description of the Prior Art

The use of cord retaining housing devices is known in the prior art. U.S. Pat. No. 4,643,505 describes a device which includes a housing having a shaped adapted for holding a pair of mated plugs and which also includes securing members for holding the cords of the plugs. Another type of cord retaining housing device is U.S. Pat. No. 3,183,302 that has a cylindrical housing which again includes securing members for holding a plug therein. Another such device is found in U.S. Pat. No. 4,749,363 that has a shaped adapted for holding an extension plug having three positions thereon for receiving three male plugs.

While these devices fulfill their respective, particular objectives and requirements, the need remains for a device which is simpler in design for lowered costs of construction and for easier use. Additionally, the device should have a coupler adapted for retaining the device in a closed position. The coupler should be of such a construction that it is not accidentally opened when struck by another object.

SUMMARY OF THE INVENTION

The present invention meets the needs presented above by generally comprising a housing that has a first end wall, a second wall and a peripheral wall extending between the first and second end walls. The peripheral wall has a break therein so that a first section and a second section are defined. The first section is selectively separable from the second section and the first and second end walls. The first section has first edge and a second edge. A hinge hingedly couples the first edge to the second section so that the second edge is selectively positionable in a closed position abutting the second section or in an open position spaced from the second section. Each of the first and second ends walls has a distal edge with respect to the second section. Each of the distal edges has a notch therein. A mated female and male plug is positioned in the housing. Cords attached the male and female plugs are placed in the notches and the first section is positioned in the closed position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
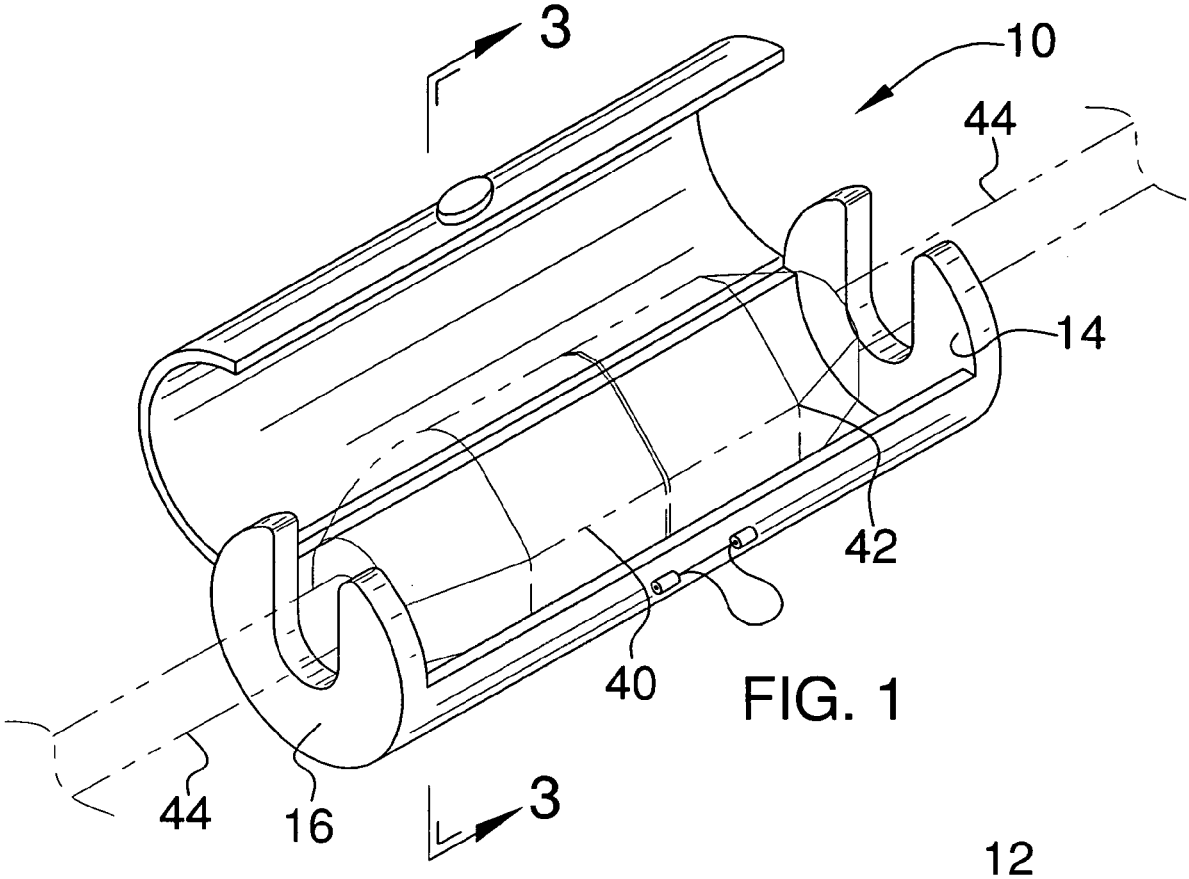
FIG. 1 is a perspective in-use view of a cord retaining housing and method according to the present invention.
Figure 2:
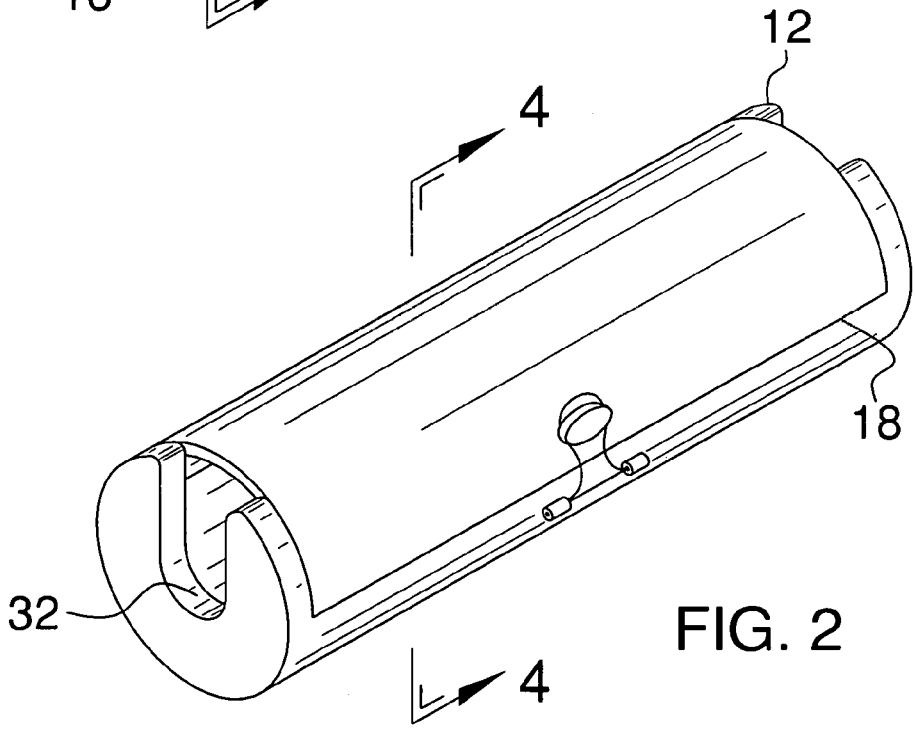
FIG. 2 is a perspective view of the present invention.
Figure 3:
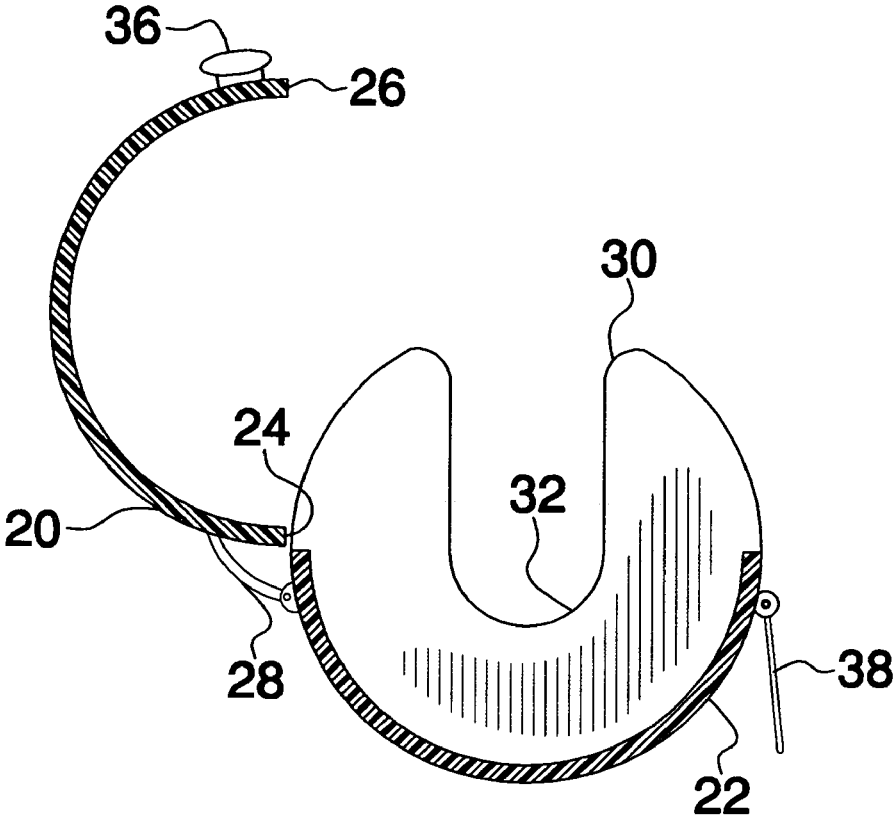
FIG. 3 is a cross-sectional view taken along line 3—3 of FIG. 1 of the present invention.
Figure 4:
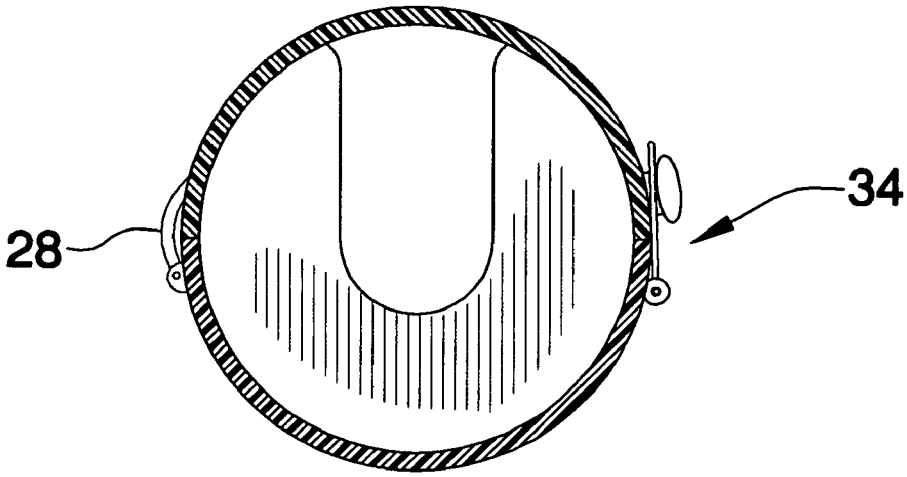
FIG. 4 is a cross-sectional view taken along line 4—4 of FIG. 2 of the present invention.

With reference now to the drawings, and in particular to FIGS. 1 through 4 thereof, a new cord retaining housing device embodying the principles and concepts of the present invention and generally designated by the reference numeral 10 will be described.

As best illustrated in FIGS. 1 through 4, the cord retaining housing and method 10 generally comprises providing a housing 12 that has a first end wall 14, a second wall 16 and a peripheral wall 18 extending between the first 14 and second 16 end walls. The peripheral wall 18 has a break therein so that a first section 20 and a second section 22 are defined. The first section 20 is selectively separable from the second section 22 and the first 14 and second 16 end walls. The first section 20 has first edge 24 and a second edge 26. A hinge 28 hingedly couples the first edge 24 to the second section 22 so that the second edge 26 is selectively positionable in a closed position abutting the second section 22 or in an open position spaced from the second section 22. Each of the first 14 and second 16 end walls has a distal edge 30 with respect to the second section 22. Each of the distal edges 30 has a notch 32 therein. The notches 32 each extend to a central area of a respective one of the first 14 and second 16 end walls. The peripheral wall 18 is cylindrically shaped. Each of the first 14 and second 16 end walls is planar.

A coupler 34 is attached to the housing 12 for selectively locking the first section 20 in the closed position. The coupler 34 includes a post 36 that is attached to the first section 20 and a clip 38 is hingedly coupled to the second section 22. The post 36 is positioned adjacent to the second edge 26 and the clip 38 is positioned for releasably receiving the post 36.

In use, a mated female 40 and male plug 42 are positioned in the housing 12. Each of the female 40 and male 42 plugs has a cord 44 attached thereto. Each of the cords 44 is positioned in one of the notches 32. The first section 20 is positioned in the closed position and the first section 20 is locked to the second section 22 with the coupler 34.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of retaining a male and female plug in an engaged position, said method comprising:

providing a housing having a first end wall, a second end wall and a peripheral wall extending between said first and second end walls, said peripheral wall having a break therein such that a first section and a second section are defined, said first section being selectively separable from said second section and said first and second end walls, said first section having first edge and a second edge, a hinge hingedly coupling said first edge to said second section such that said second edge is selectively positionable in a closed position abutting said second section or in an open position spaced from said second section, each of said first and second ends walls having a distal edge with respect to said second section, each of said distal edges having a notch therein, each of said first and second end walls being planar and having a substantially circular shape, each of said notches extending to a central area of a respective one of said first and second end walls;

positioning mated female and male plug in said housing, each of said female and male plugs having a cord attached thereto;

positioning each of said cords in one of said notches; and positioning said first section in said closed position.

2. The method according to claim 1, wherein said peripheral wall is cylindrically shaped.

3. The method according to claim 1, further providing a coupler being attached to said housing for selectively locking said first section in said closed position, and further including the step of locking said first section to said second section with said coupler.

4. The method according to claim 3, wherein said coupler includes a post being attached to said first section and a clip being hingedly coupled to said second section, said post being positioned adjacent to said second edge and said clip being positioned for releasably receiving said post.

5. The method according to claim 1, wherein each of said notches includes a pair of side edges orientated substantially parallel to each other and extending away from a corresponding one of said distal edges.

6. A method of retaining a male and female plug in an engaged position, said method comprising:

providing a housing having a first end wall, a second end wall and a peripheral wall extending between said first and second end walls, said peripheral wall having a break therein such that a first section and a second section are defined, said first section being selectively separable from said second section and said first and second end walls, said first section having first edge and a second edge, a hinge hingedly coupling said first edge to said second section such that said second edge is selectively positionable in a closed position abutting said second section or in an open position spaced from said second section, each of said first and second ends walls having a distal edge with respect to said second section, each of said distal edges having a notch therein, each of said notches extending to a central area of a respective one of said first and second end walls, said peripheral wall being cylindrically shaped, each of said first and second end walls being planar and having a substantially circular shape, each of said notches including a pair of side edges orientated substantially parallel to each other and extending away from a corresponding one of said distal edges;

providing a coupler being attached to said housing for selectively locking said first section in said closed position, said coupler including a post being attached to said first section and a clip being hingedly coupled to said second section, said post being positioned adjacent to said second edge and said clip being positioned for releasably receiving said post;

positioning mated female and male plug in said housing, each of said female and male plugs having a cord attached thereto;

positioning each of said cords in one of said notches;

positioning said first section in said closed position; and locking said first section to said second section with said coupler.

* * * * *